US009306359B2

(12) United States Patent
Li et al.

(10) Patent No.: US 9,306,359 B2
(45) Date of Patent: Apr. 5, 2016

(54) WELL CO-PLANE CARD EDGE CONNECTOR

(71) Applicant: HON HAI PRECISION INDUSTRY CO., LTD., New Taipei (TW)

(72) Inventors: Hua Li, Kunshan (CN); Zhen-Hua Wang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 31 days.

(21) Appl. No.: 14/070,581

(22) Filed: Nov. 4, 2013

(65) Prior Publication Data

US 2014/0127925 A1 May 8, 2014

(30) Foreign Application Priority Data

Nov. 2, 2012 (CN) ..... 2012 2 0572236 U

(51) Int. Cl.

| | |
|---|---|
| ***H01R 24/00*** | (2011.01) |
| ***H01R 43/24*** | (2006.01) |
| ***H01R 12/72*** | (2011.01) |
| *H01R 13/506* | (2006.01) |

(52) U.S. Cl.

CPC ..... *H01R 43/24* (2013.01); *H01R 12/721* (2013.01); *H01R 12/727* (2013.01); *H01R 13/506* (2013.01); *Y10T 29/4922* (2015.01)

(58) Field of Classification Search

CPC . H01R 27/00; H01R 23/7068; H01R 23/7005
USPC ..... 439/634, 637, 633, 630, 325, 328
See application file for complete search history.

(56) References Cited

U.S. PATENT DOCUMENTS

| | | | | |
|---|---|---|---|---|
| 2006/0014436 | A1* | 1/2006 | Wu | H01R 13/64 439/630 |
| 2011/0130041 | A1* | 6/2011 | Chen | H01R 12/721 439/630 |
| 2012/0225588 | A1* | 9/2012 | Westman | H01R 12/721 439/636 |

FOREIGN PATENT DOCUMENTS

| | | |
|---|---|---|
| CN | 202363640 U | 8/2012 |
| TW | M422802 | 2/2012 |

* cited by examiner

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

A card edge connector includes a first insulating housing loaded with a plurality of first terminals, a second insulating housing loaded with a plurality of second terminals. A card receiving slot is defined between the first insulating housing and the second insulating housing with a key disposed in the card receiving slot. The first terminals and the second terminals are disposed at two opposite sides of the card receiving slot and comprising contacting portions extending in the card receiving slot. The first insulating housing defines a pair of locking arms at opposite ends thereof and extending towards the second insulating housing, the second insulating housing defines a pair of locking recesses, the locking arms are locking with the locking recesses thereby the first and second insulating housing are snugly attached together.

16 Claims, 4 Drawing Sheets

WELL CO-PLANE CARD EDGE CONNECTOR

BACKGROUND OF THE INVENTION

1. Field of the Invention

The present invention relates to a card edge connector, and more particularly to a well co-plane card edge connector.

2. Description of the Related Art

CN Pat. Issued No. 201120472638.7 issued to HONGZE Incorporated. on Aug. 1, 2012, discloses a card edge connector, which includes a lengthwise insulating housing, a plurality of terminals fixed to the housing. The terminals are set in two rows, one row of the terminals are insert-molding into the housing to realize a miniaturization of the card edge connector. During soldering the terminals onto the PCB, the housing may be distort, and the co-plane of the soldering portions may be influenced.

Therefore, an improved card edge connector is desired to overcome the disadvantages of the related arts.

BRIEF SUMMARY OF THE INVENTION

An object of the present invention is to provide a card edge connector which benefit to the co-plane of soldering portions of the terminals.

In order to achieve above-mentioned object, a card edge connector a first insulating housing loaded with a plurality of first terminals, a second insulating housing loaded with a plurality of second terminals. A card receiving slot is defined between the first insulating housing and the second insulating housing with a key disposed in the card receiving slot. The first terminals and the second terminals are disposed at two opposite sides of the card receiving slot and comprise contacting portions extending in the card receiving slot. The first insulating housing defines a pair of locking arms at opposite ends thereof and extending towards the second insulating housing, the second insulating housing defines a pair of locking recesses, the locking arms are locking with the locking recesses thereby the first and second insulating housing are snugly attached together.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
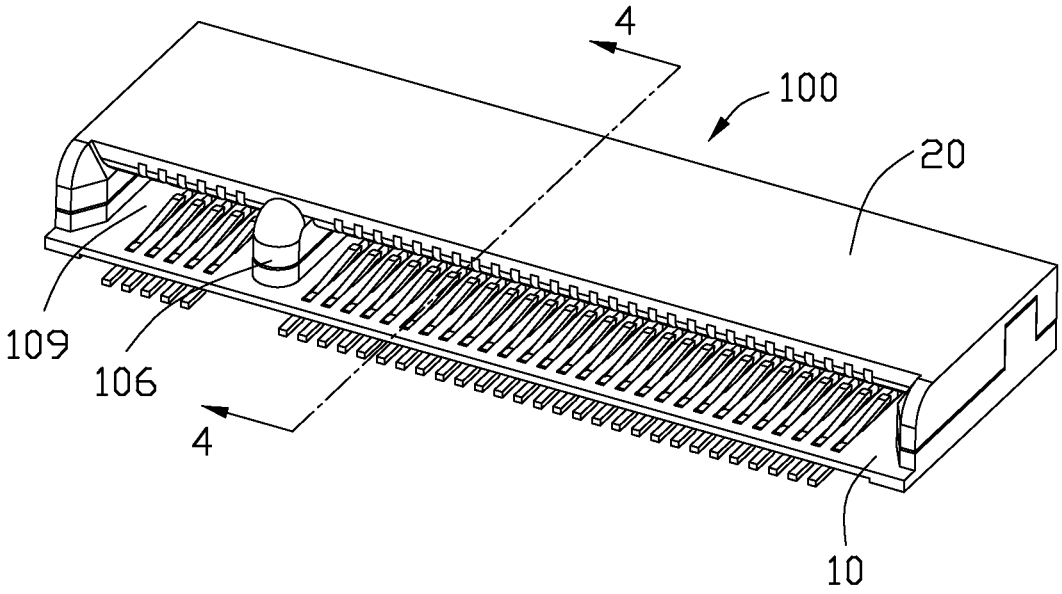
FIG. 1 is a perspective view of card edge connector in accordance with the present invention.
Figure 2:
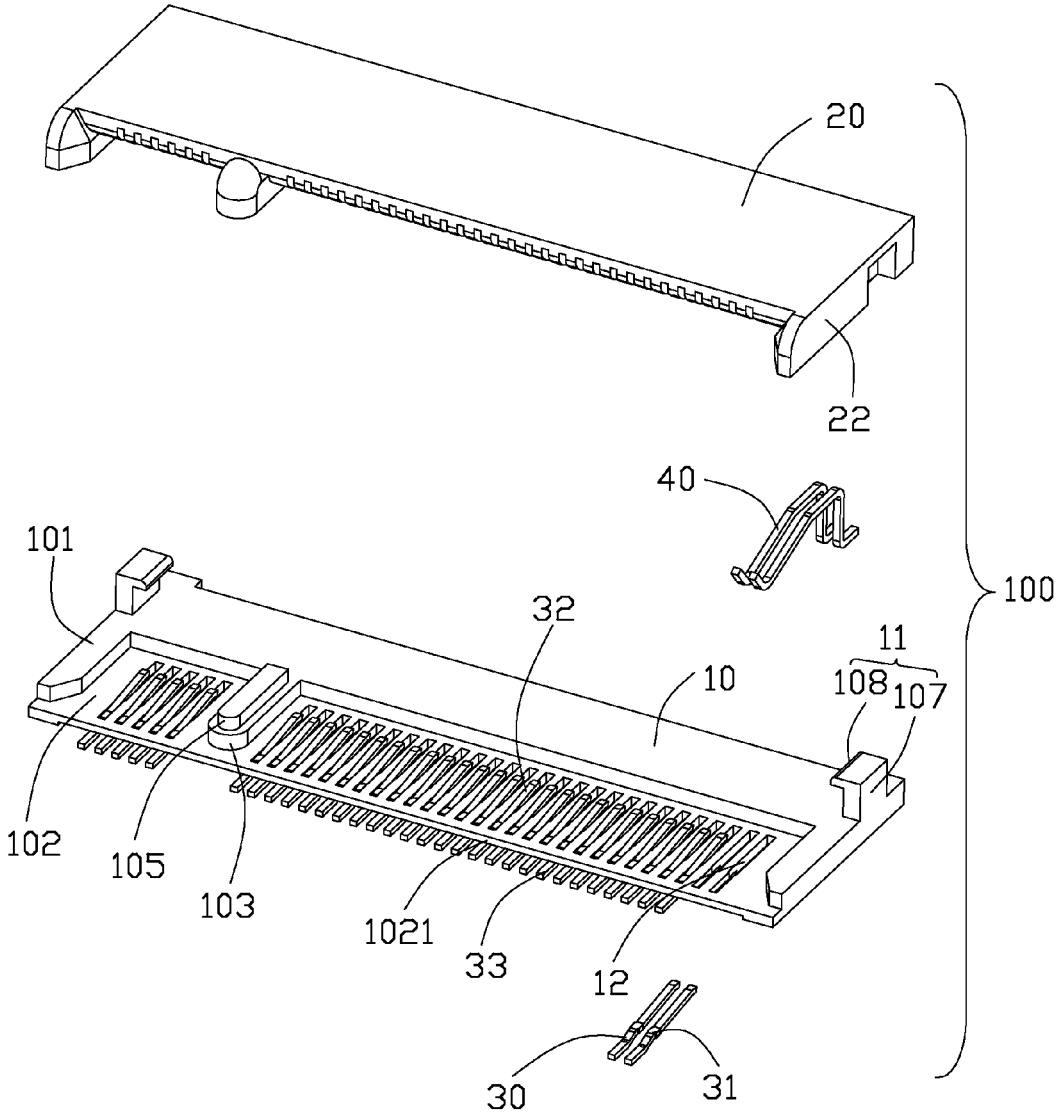
FIG. 2 is an exploded perspective view of the card edge connector.
Figure 4:
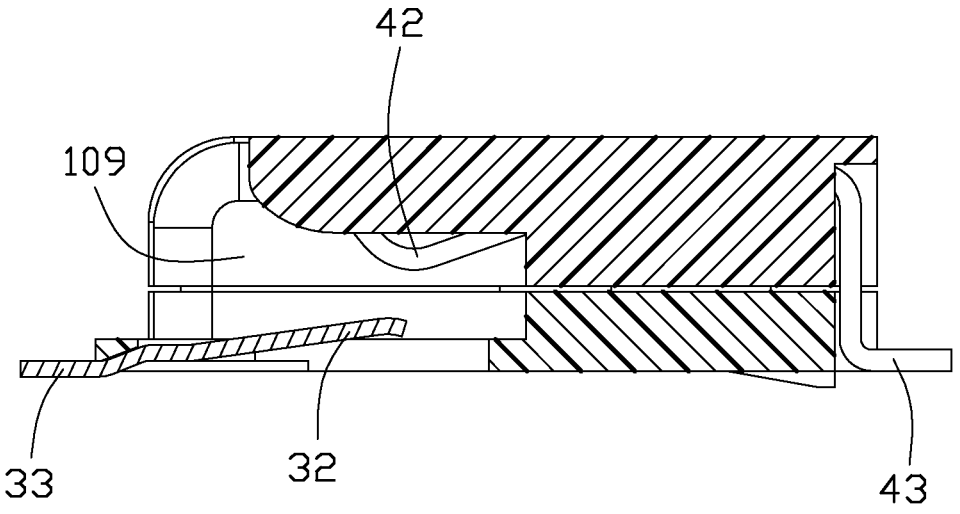
FIG. 4 is a cross-sectional view of the card edge connector taken along line 4-4 in FIG. 1.

Reference will now be made to the drawing figures to describe a preferred embodiment of the present invention in detail. FIG. 1 and FIG. 2 illustrate a card edge connector 100, which includes a first or lower insulating housing 10 attached with a plurality of first or lower terminals 30, and a second or upper insulating housing 20 with a plurality of second or upper terminals 40. The first and second insulating housings are snugly attached to each other, thereby constructing said connector with a front opening card-receiving slot 109 labeled in FIG. 4 with a mis-mating-proof key 106. The first and second terminals define contacting portions 32, 42 projecting in the card-receiving slot 109.

Figure 3:
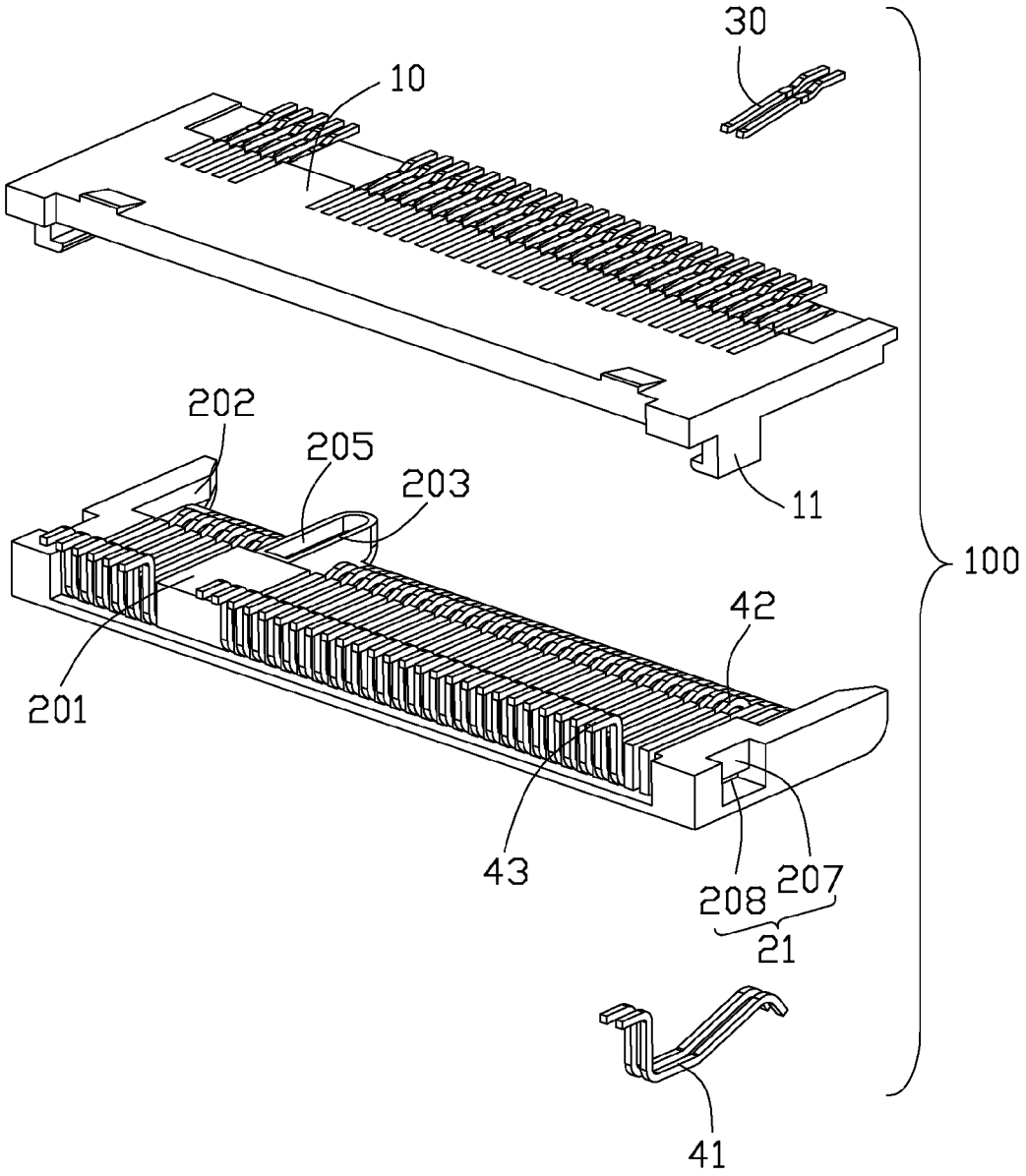
FIG. 3 is another perspective view of the card edge connector shown in FIG. 2.

Referring to FIG. 2 and FIG. 3, the first insulating housing 10 defines a first face 101, a first recess 102 recessed downwards from the first face 101, the first recess 102 is defined at a front portion of the first housing and opening upwards and forwards. A row of terminal passageways 12 extending along a front and rear direction and arranged in a longitudinal direction is defined in the first recess 102. The terminal passageways run through an upper face of the first recess and a bottom face or a mounting face of the first housing 10. A first projection 103 extends forward in the first recess 102, which is co-plane with the first face 101. A key retaining boss 105 is defined on a top face of the first projection 103. A pair of locking arms 11 is disposed at two longitudinal ends of the first face 101, each locking portion 11 defines an upright arm 107 extending vertically from the first face 101 towards the second housing 20 and a hook portion 108 extending inwardly from the distal end of the upright arm 107.

The first terminals 30 comprise contacting portions 32, soldering portions 33 extend from the contacting portions beyond a front edge 1021 of the housing 12, and retaining portions 31 connect with the contacting portions and soldering portions. The first terminals 30 are assembled to terminal passageways 12 from the mounting face of the first housing. The retaining portions 31 are retained in the first housing 10, the soldering portions 33 extend out of the front face of the first housing 10 and the contacting portions 32 of the first terminals 30 extending into the first recess 102 with a small acute angle since the contacting portions 32 slant upwards from the retaining portions 31, which benefits to minimize a height of the card edge connector 100.

The second insulating housing 20 defines a second face 201, a second recess 202 is recessed at the second face 201. A second projection 203 extends forward in the second recess 202, which is co-plane with the second face 201. A key retaining hole 205 is defined in the second projection 203. A pair of locking recess 21 is disposed at two longitudinal ends of the second housing 20, each locking recess 21 defines a larger recess 207 running through the second face 201 and a small recess 208 recessed inwards from the end.

The second terminals 40 comprise contacting portions 42 extending into the second recess 202, retaining portions 41 retained in the second housing 20 and soldering portions 43 extending out of the rear surface of the second housing 20.

After the first and second terminals loaded on the first and second insulating respectively, the first and second insulating housing are assembled together to commonly form the card edge connector 100. The second insulating housing 20 is moved towards the first insulating housing 10, the locking arms 11 are locked with the locking recess 21 wherein the upright arms 107 are received in the larger recess 207 and the hooking portions 108 are inserted into the smaller recess 208, so that said two housing are attached together. The key retaining boss 105 is inserted into and retained in key retaining hole 205, thereby the first projection 103 and the second projection 203 being coordinated to the key 106 as shown in FIG. 1. The first recess 102 and the second recess 202 commonly define the card receiving slot 109 between the first insulating housing 10 and the second insulating housing 20. The contacting portions 32 of the first terminals 30 and the contacting portions 42 of the second terminals 40 are arranged at two opposite sides of the card receiving slot 109, and offset from each other.

The key retaining boss 105 and key retaining hole 205 coordinate with each other to prevent the second housing 20 from moving from the first housing 10 in the front and back direction and a left and right direction. Please notes, the height of smaller recess 208 is larger than that of the hooking portion 108, so that the first and the second insulating housing can adjust with a smaller distance in the upper and lower direction, which will benefit to get a good co-plane during the soldering portions are soldered to a printed circuit board.

During the soldering, the second housing 20 may be distort, and the co-plane of the soldering portions of the first terminals and the soldering portions of the second terminals is hard to keep. In this invention, the card edge connector 100 overcome this problem by making the height of the second locking recesses 208 larger than that of the hooking portions 108 so as to enable the hooking portions 108 float in the second recesses 208 and the co-plane of the soldering portions of the first and second terminals can be adjusted.

It is noted that the arrangement of the respective first insulating housing 10 with the associated first terminals 30, and the respective second insulating housing 20 with the associated second terminals 40 may also ease manufacturing/assembling of the whole connector 100. Understandably, the first terminals 30 may be insert-molded within the first insulating housing 10 so as to allow deceasing the height of the first insulating housing 20 for a low profile configuration of the whole connector 100 as what is disclosed in the aforementioned related art, i.e., CN Pat. Issued No. 201120472638.7. Anyhow, in such a related art, because only a single housing is used, it requires to use a horizontally moved primary mold and a vertically moved slide mold for the mold design and removal of the primary mold/slide mold requires deflection of the terminal which may tend to damage the curved portion of the terminal. In opposite, in the instant invention the first/lower insulating housing 10 and the associated first terminals 30 are allowed to be made via a pair of vertically moved primary molds instead of one primary mold and one slide mold disclosed in the related art during the insert-molding process, and this arrangement may not only ease the insert-molding process and but also require no deflection of the terminals during removal of the molds, thus avoiding the possible damage to the terminals and also keeping the sufficient dimension of the lower housing without lengthening the corresponding passageway for strength consideration. In brief, the two-piece housing design not only allows the floating arrangement for terminal tail surface mounting consideration but also eases/perfects the insert-molding of the lower terminals in the lower portion of the whole connector advantageously.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector comprising:

a first insulating housing loaded with a plurality of first terminals;

a second insulating housing loaded with a plurality of second terminals;

a card receiving slot being defined between the first insulating housing and the second insulating housing with a key disposed in the card receiving slot;

the first terminals and the second terminals disposed at two opposite sides of the card receiving slot and comprising contacting portions extending in the card receiving slot;

wherein the first insulating housing defines a pair of locking arms at opposite ends thereof and extending towards the second insulating housing, the second insulating housing defines a pair of locking recesses, the locking arms are locking with the locking recesses thereby the first and second insulating housing are snugly attached together; wherein the first housing defines a first face and a first recess recessed from the first face, the contacting portions of the first terminals extend in the first recess; the second housing defines a second face and a second recess recessed from the second face, the contacting portions of second terminals extend in the second recess; the first recess and second recess commonly define the card receiving slot; wherein a first projection extend forwards in the first recess extends and a key retaining boss projecting toward the second insulating housing from a top face of the first projection; a second projection extend forward in the second recess and a key retaining hole is disposed in the second projection; the key retaining boss is retained in the key retaining hole, thereby the first and the second projection commonly define said key.

2. The card edge connector as described in claim 1, wherein the top face of the first projection is co-plane with the first face.

3. The card edge connector as described in claim 1, wherein the locking arms define upright arms extending vertically from the first face towards the second face and hooking portions extending inwardly from distal ends of the upright arms; the locking recesses define larger recesses recessed from side walls of the second housing and smaller recesses recessed inwardly from the larger recesses; the upright arms are received in the larger recesses and the hooking portions are locked into the smaller recesses.

4. The card edge connector as described in claim 3, wherein the smaller recesses is larger than the hooking portions in a vertical direction of the connector so as to enable the hooking portions float in the smaller recesses.

5. A card edge connector comprising:

a lower insulating housing and an upper insulative housing discrete from each other while assembled to each other to commonly define a card receiving slot therebetween in a vertical direction, said card receiving slot forwardly communicating, via a front opening, with an exterior in a front-to-back direction perpendicular to said vertical direction;

a plurality of lower contacts integrally formed with the lower insulating housing via an insert-molding process and deflectable in the vertical direction, said lower contacts being arranged with one another along a transverse direction perpendicular to both said vertical direction and said front-to-back direction while each of said lower contacts extending along said front-to-back direction with a lower retention section around the front opening and a lower contacting section extending rearwardly and upwardly into the card receiving slot; and a plurality of upper contacts associated with the upper insulative housing and deflectable in the vertical direction, said upper contacts being arranged with one another along the transverse direction while each of said upper contacts extending along said front-to-back direction with an upper retention section around a rear portion of the upper insulative housing and an upper contacting section extending forwardly and downwardly into the card receiving slot; wherein the upper insulative housing is assembled upon the lower insulating housing; wherein the lower insulating housing defines a plurality of lower passageways to allow the corresponding lower contacts to be moveable therein, and the card receiving slot extends rearward deeper than the lower passageways in the front-to-back direction.

6. The card edge connector as claimed in claim 5, wherein a step is formed between the card receiving slot and the lower passageway in the lower insulating housing.

7. The card edge connector as claimed in claim 5, wherein said upper insulating housing is up-and-down floatable relative to the lower insulating housing after assembled.

8. The card edge connector as claimed in claim 5, wherein an interface between the upper insulating housing and the lower insulating housing in the vertical direction occurs around a middle level of the card receiving slot.

9. The card edge connector as claimed in claim 5, wherein said upper insulating housing and said lower insulating housing are configured to be assembled to each other in the vertical direction.

10. The card edge connector as claimed in claim 9, further including means for assembling the upper insulating housing and the lower insulating housing in the vertical direction in an up-and-down floating manner.

11. The card edge connector as claimed in claim 5, wherein the upper contacts are not insert molded within the upper insulating housing but being assembled thereinto.

12. A card edge connector comprising:

a lower insulating housing and an upper insulative housing discrete from each other while assembled to each other to commonly define a card receiving slot therebetween in a vertical direction, said card receiving slot forwardly communicating, via a front opening, with an exterior in a front-to-back direction perpendicular to said vertical direction;

a plurality of lower contacts integrally formed with the lower insulating and deflectable in the vertical direction, said lower contacts being arranged with one another along a transverse direction perpendicular to both said vertical direction and said front-to-back direction while each of said lower contacts extending along said front-to-back direction with a lower retention section around the front opening and a lower contacting section extending rearwardly and upwardly into the card receiving slot; and a plurality of upper contacts associated with the upper insulative housing and deflectable in the vertical direction, said upper contacts being arranged with one another along the transverse direction while each of said upper contacts extending along said front-to-back direction with an upper retention section around a rear portion of the upper insulative housing and an upper contacting section extending forwardly and downwardly into the card receiving slot; wherein said upper insulating housing is up-and-down floatable relative to the lower insulating housing after assembled; wherein the lower insulating housing defines a plurality of lower passageways to allow the corresponding lower contacts to be moveable therein, and the card receiving slot extends rearward deeper than the lower passageways in the front-to-back direction.

13. The card edge connector as claimed in claim 12, wherein a step is formed between the card receiving slot and the lower passageway in the lower insulating housing.

14. The card edge connector as claimed in claim 12, wherein an interface between the upper insulating housing and the lower insulating housing in the vertical direction occurs around a middle level of the card receiving slot.

15. The card edge connector as claimed in claim 12, wherein said upper insulating housing and said lower insulating housing are configured to be assembled to each other in the vertical direction.

16. The card edge connector as claimed in claim 15, further including means for assembling the upper insulating housing and the lower insulating housing in the vertical direction in an up-and-down floating manner.

* * * * *